US006845808B2

(12) United States Patent
Ban

(10) Patent No.: US 6,845,808 B2
(45) Date of Patent: Jan. 25, 2005

(54) REDUCTION CASTING METHOD

(75) Inventor: Keisuke Ban, Nagano-ken (JP)

(73) Assignee: Nissin Kogyo Co., Ltd., Nagano-Ken (JP)

( * ) Notice: Subject to any disclaimer, the term of this patent is extended or adjusted under 35 U.S.C. 154(b) by 94 days.

(21) Appl. No.: 10/384,718

(22) Filed: Mar. 11, 2003

(65) Prior Publication Data

US 2003/0217827 A1 Nov. 27, 2003

(30) Foreign Application Priority Data

Mar. 13, 2002 (JP) ..... P.2002-068213

(51) Int. Cl.[7] ..... B22D 27/00; B22D 27/18; B22C 3/00

(52) U.S. Cl. ..... 164/56.1; 164/67.1; 164/72

(58) Field of Search ..... 164/56.1, 66.1, 164/67.1, 61, 72

(56) References Cited

FOREIGN PATENT DOCUMENTS

| | | |
|---|---|---|
| JP | 2001-321918 | * 11/2001 |
| JP | 2002-30356 | * 1/2002 |

* cited by examiner

*Primary Examiner*—Kuang Y. Lin
(74) *Attorney, Agent, or Firm*—McGuireWoods LLP

(57) ABSTRACT

A reduction casting method includes the steps of: allowing a metallic gas and a reactive gas to react with each other to generate a reducing compound; introducing the thus-generated reducing compound into a cavity of a molding die 11; and reducing an oxide film formed on a surface of a molten metal by the reducing compound to cast a cast product. The reduction casting method uses a non-reactive gas as a carrier gas when the metallic gas is introduced into the cavity, in which a flow quantity of the non-reactive gas is allowed to be from one sixth to twice that of the reactive gas.

4 Claims, 2 Drawing Sheets

REDUCTION CASTING METHOD

BACKGROUND OF THE INVENTION

1. Field of Invention

The present invention relates to a reduction casting method. More particularly, the invention relates to a reduction casting method in which casting can be performed in a favorable state-without impairing reducing strength.

2. Description of the Related Art

There are various types of casting methods such as a gravity casting method (GDC), a low pressure die casting method (LPDC), a die casting method (DC), a squeeze casting method (SC) a thixomolding method. All of these methods perform casting by pouring molten metal into a cavity of a molding die, thereby molding the thus-poured molten metal into a predetermined shape. Among these casting methods, in a method in which an oxide film is likely to be formed on a surface of the molten metal, for example, at aluminum casting or the like, a surface tension of the molten metal is increased by the oxide film formed on the surface of the molten metal to deteriorate a flowing property, a running property and an adhesive property of the molten metal thereby causing problems of casting imperfections such as insufficient filling, a surface fold and the like.

As a method to solve these problems, the present applicant has proposed a reduction casting method which is capable of performing casting by reducing an oxide film formed on a surface of the molten metal (for example, JP-A-2001-321918). In this reduction casting method, a magnesium-nitrogen compound ($Mg_3N_2$) having a strong reducing property is prepared by using a nitrogen gas and a magnesium gas and, then, the thus-prepared magnesium-nitrogen compound is allowed to act on the molten metal of aluminum, thereby performing casting. The magnesium gas is generated in a furnace and, when the magnesium gas is introduced into a cavity, an inert gas (argon gas) is used as a carrier gas. The nitrogen gas is directly introduced into the cavity in a separate manner.

According to the above-described reduction casting method, by pouring the molten metal into the cavity of a molding die in a state in which the magnesium-nitrogen compound is deposited on a surface of the cavity of the molding die, when the molten metal comes into contact with the surface of the cavity, the oxide film formed on the surface of the molten metal is reduced by a reducing action of the magnesium-nitrogen compound to change the surface of the molten metal into pure aluminum, thereby decreasing a surface tension of the molten metal and, accordingly, enhancing a flowing property of the molten metal. As a result, a running property of the molten metal becomes advantageous whereupon a cast product which does not have a cast imperfection but has an excellent appearance deprived of a surface fold or the like can be obtained.

However, there are problems as described below in the above-described reduction casting method.

Namely, in the reduction casting method, although it is necessary to control quantities of the magnesium gas and the nitrogen gas, the magnesium gas which is obtained by heat-subliming magnesium in the furnace is in a state of high temperature (about 800° C.).

It is difficult to measure the quantity of this magnesium gas in a state of high temperature and, therefore, it is unable to precisely control quantities of both gases, and thus, problems are generated such that the quantity of the magnesium gas becomes insufficient, reduction strength is deteriorated, qualities of cast products are varied thereamong and the like.

SUMMARY OF THE INVENTION

Under these circumstances, the present invention has been achieved to solve these problems, and an object of the invention is to provide a reduction casting method which can performs casting in an advantageous state without impairing reducing strength.

In order to attain the object, the invention has a constitution described below.

Namely, according to the invention, there is provided a reduction casting method, comprising the steps of:

allowing a metallic gas and a reactive gas to react with each other to generate a reducing compound;

introducing the thus-generated reducing compound into a cavity of a molding die; and reducing an oxide film formed on a surface of a molten metal by the reducing compound to cast a cast product, the reduction casting method using a non-reactive gas as a carrier gas when the metallic gas is introduced into the cavity, wherein a flow quantity of the non-reactive gas is allowed to be from one sixth to twice a flow quantity of the reactive gas.

Further, preferably, the flow quantity of the non-reactive gas is allowed to be from one fourth to one half the flow quantity of the reactive gas.

Still further, the reactive gas, the non-reactive gas and the metallic gas are allowed to be a nitrogen gas, an argon gas and a magnesium gas, respectively.

DETAILED DESCRIPTION OF THE PREFERRED EMBODIMENTS

Hereinafter, a preferred embodiment of the present invention will be described in detail with reference to accompanying drawings.

Figure 1:
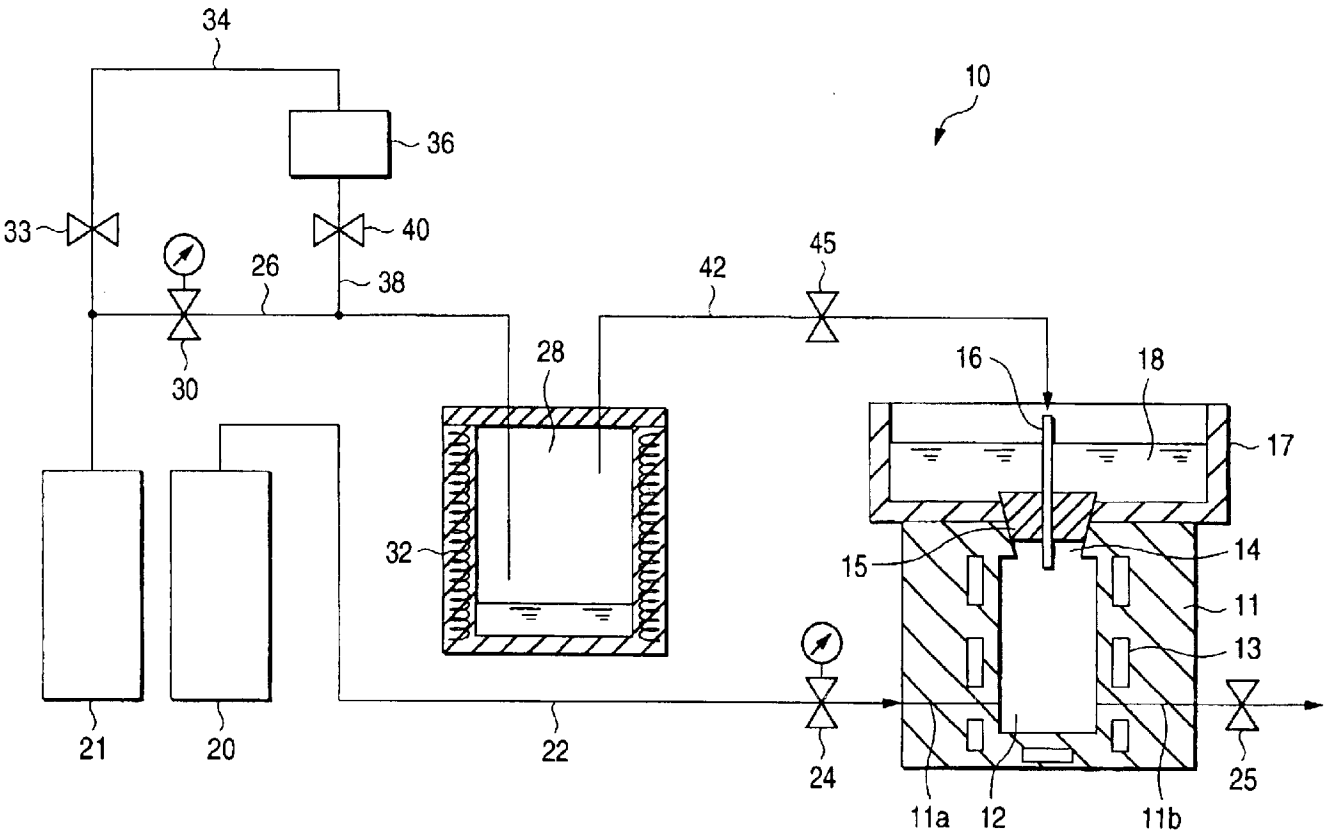
FIG. 1 is an explanatory diagram illustrating an example of a constitution of a casting apparatus which performs casting by a reduction casting method according to the present invention.

FIG. 1 is an explanatory diagram showing an entire constitution of a casting apparatus 10 for performing casting by utilizing a reduction casting method according to the invention. An application thereof for aluminum casting is illustrated below; however, the invention is by no means limited to the aluminum casting.

In FIG. 1, reference numerals 11 and 12 denote a molding die and a cavity formed inside the molding die 11, respectively. In an upper part of the cavity 12, a sprue 14 shaped in a state of a tapered surface which becomes gradually smaller downward in diameter is provided. In the sprue 14, a plug 15 is detachably provided. A reference numeral 16 denotes a pipe which is vertically formed to pass through the plug 15.

A reference numeral 17 denotes a reservoir for containing the molten metal to be poured (hereinafter also referred to simply as "molten metal reservoir") provided in the upper part of the molding die 11. The molten metal reservoir 17 and the cavity 12 are communicated with each other via the sprue 14. By performing an opening/closing operation of the plug 15, pouring of the molten metal into the cavity 12 is controlled. In a case of the present embodiment which illustrates the application of the reduction casting method according to the invention to the aluminum casting, the molten metal of aluminum is stored in the molten metal reservoir 17.

Materials for the molding die 11 are not particularly limited; however, the molding die 11 may be formed by using a material having favorable thermal conductivity. Further, the molding die 11 is provided with a cooling device with which it is forcibly cooled. In the embodiment, as the cooling device, a flow passage 13 is provided inside the molding die 11 such that cooling-water is allowed to constantly run through the flow passage 13. A reason for forming the molding die 11 by using the material having favorable thermal conductivity and constantly forcibly cooling the molding die 11, is to hold a temperature thereof to be as low as possible. Therefore, so long as a cooling method is such that the temperature of the molding die 11 is effectively held to be low, the cooling method is not necessarily limited to such a water-cooling method as described above. It goes without saying that a plurality of cooling devices can simultaneously be used in combination.

In FIG. 1, a reference numeral 20 denotes a steel cylinder 20 for containing a nitrogen gas (hereinafter also referred to "nitrogen gas-containing steel cylinder"). The nitrogen gas-containing steel cylinder 20 is connected to the molding die 11 via a piping system 22 in which a valve 24 is interposed and is arranged such that the nitrogen gas is allowed to be introduced into the cavity 12 through a nitrogen gas-introducing port 11*a* provided in the molding die 11. By opening the valve 24 to feed the nitrogen gas into the cavity 12 through the nitrogen gas-introducing port 11*a*, air present in the cavity 12 is purged therefrom to produce a nitrogen gas atmosphere in the cavity 12, so that a non-oxygen atmosphere is substantially produced in the cavity 12. A reference numeral 11*b* denotes an exhaust port provided in the molding die 11. It is also possible that the non-oxygen atmosphere is produced in the cavity 12 by connecting a vacuum device to the exhaust port 11*b* via the piping system in which a valve 25 is interposed and, then, operating the vacuum device in a state in which the valve 25 is opened.

A reference numeral 21 denotes a steel cylinder for containing an argon gas (hereinafter also referred to as "argon gas-containing steel cylinder"). The argon gas-containing steel cylinder 21 is connected to a furnace 28 which is a generator for generating a metallic gas via a piping system 26. By performing an opening/closing operation of a valve 30 which is interposed in the piping system 26, pouring of the argon gas into the furnace 28 is controlled. The furnace 28 is heated by a heater 32. In the embodiment, a temperature in the furnace 28 is set to be a boiling point or less of magnesium, as well as a melting point or more of magnesium so that magnesium in the furnace 28 becomes in a liquid state.

The argon gas-containing steel cylinder 21 is also connected to a tank 36 in which magnesium metal is contained via a piping system 34 in which a valve 33 is interposed; further, the tank 36 is connected to the piping system 26 in a downstream side of the valve 30 via a piping system 38. A reference numeral 40 denotes a valve, which is interposed in the piping system 38, for use in controlling a supply quantity of magnesium to the furnace 28. The tank 36 is used for containing magnesium metal to be supplied to the furnace 28, and the magnesium metal is contained therein in powder or granular form.

The furnace 28 is connected to the cavity 12 of the molding die 11 via a piping system 42 and the pipe 16 which is attached to the plug 15. Magnesium in gas or mist form which has been produced in the furnace 28 is introduced into the cavity 12 of the molding die 11 by performing an opening/closing operation of a valve 45 which is interposed in the piping system 42 and also controlling an argon gas pressure by the valve 30.

Aluminum casting by the casting apparatus 10 as shown in FIG. 1 is performed in a manner as described below.

Firstly, the valve 24 is opened in a state in which the sprue 14 is closed by being fitted with the plug 15 to pour the nitrogen gas from the nitrogen gas-containing steel cylinder 20 into the cavity 12 of the molding die 11 via the piping system 22. By such pouring of the nitrogen gas, air present inside the cavity 12 is purged therefrom, whereby a non-oxygen atmosphere is substantially produced in the cavity 12 and, then, the valve 24 is closed.

During a time period in which the nitrogen gas is poured into the cavity 12 of the molding die 11 or before such pouring, the valve 30 is opened to pour the argon gas from the argon gas-containing steel cylinder 21 into the furnace 28 to produce a non-oxygen atmosphere in the furnace 28. Next, the valve 30 is closed and the valves 33 and 40 are opened to send the magnesium metal contained in the tank 36 into the furnace 28 by an argon gas pressure applied from the argon gas-containing steel cylinder 21. Since the furnace 28 is heated at a temperature at which the magnesium metal is melt, the magnesium metal which has been sent in the furnace 28 turns to be in a molten state therein. Since the magnesium gas is sent out from the furnace 28 in a repeated manner every time a casting operation is performed, a certain quantity of magnesium metal which can corresponds to such operations is sent from the tank 36 to the furnace 28. After the-magnesium metal is sent in the furnace 28, valves 33 and 40 are closed.

Subsequently, the valves 30 and 45 are opened to pour the magnesium gas from the furnace 28 into the cavity 12 of the molding die 11 via the pipe 16 by using the argon gas as a carrier gas while controlling pressure and a flow quantity of the argon gas. On this occasion, magnesium in mist form is also sent out from the furnace 28 together with the magnesium gas.

After the magnesium gas is poured into the cavity 12, the valve 45 is closed and, then, the valve 24 is opened to pour the nitrogen gas into the cavity 12 through the nitrogen gas-introducing port 11*a*. By pouring the nitrogen gas into the cavity 12, the magnesium gas previously poured in the cavity 12 and the thus-poured nitrogen gas are allowed to react with each other in the cavity 12 to produce the magnesium-nitrogen compound ($Mg_3N_2$) which is a reducing compound. The magnesium-nitrogen compound is primarily deposited on a surface of an inner wall of the cavity 12.

In a state in which the magnesium-nitrogen compound is produced on such inner wall surface of the cavity 12, the plug 15 is opened to pour the molten metal 18 from the sprue 14 into the cavity 12.

The molten metal 18 of aluminum thus poured in the cavity 12 comes into contact with the magnesium-nitrogen compound produced on the inner wall surface of the cavity 12 so that the magnesium-nitrogen compound deprives oxygen from an oxide film formed on a surface of the molten metal to reduce the surface of the molten metal, to pure aluminum which is, then, filled into the cavity 12 (reduction casting method). By allowing the oxide film formed on the surface of the molten metal to be reduced, pure aluminum is exposed on the surface of aluminum, whereby the flowing property of the molten metal becomes extremely favorable.

Since the running property of the molten metal becomes, accordingly, extremely favorable, there is a merit in that it is neither necessary to use a conventional heat-insulating coating agent nor necessary to hold the molding die in high temperature.

Further, in a case of the reduction casting method as described above, since the molten metal 18 is filled into the cavity 12 in a short period of time, it is effective to cool the molten metal 18 which has been filled into the molding die 11 and solidify it in a short period of time. When the molding die 18 is made of a material having a favorable thermal conductivity, so long as the temperature of the molding die 18 is held at a temperature or less at which the molding die 18 can have a sufficient hardness, for example, about 150° C. or less, casting can be performed by a casting method which uses the molding die made of such material, while preventing scoring from being generated in contact with the molten metal.

The flow quantity of the argon gas (inert gas) which is supplied into the furnace 28 is measured by a flow meter provided together with the valve 30. Further, the flow quantity of the nitrogen gas which is supplied into the cavity 12 is measured by a flow meter provided together with the valve 24.

The magnesium gas is introduced into the cavity 12 by being transported by the argon gas as a carrier gas.

It was found by an observation that the flow quantity of the magnesium gas to be introduced approximately corresponds to that of the argon gas.

As described above, an inside of the furnace 28 is heated to 800° C. or more which is a temperature of subliming the magnesium.

Although it is difficult to measure the flow quantity of this magnesium gas at high temperature, as described above, since the flow quantity of the magnesium approximately corresponds to that of the argon gas, the flow quantity of this argon gas is measured and controlled whereupon the flow quantity of the magnesium gas can indirectly be controlled.

Qualities of cast products which have beer obtained by changing the flow quantities of the argon gas and the nitrogen gas in various ways were evaluated.

As a result, the cast product having a desired quality was able to be obtained by setting the flow quality of the argon gas to be one sixth to twice that of the nitrogen gas.

When the flow quantity of the argon gas is less than one sixth that of the nitrogen gas, a quantity of the magnesium gas is decreased and, accordingly, a quantity of the magnesium-nitrogen compound is decreased and, therefore, the reducing strength is reduced whereby the desired quality was unable to be obtained. Further, when the flow quality of the argon gas is more than twice that of the nitrogen gas, the quantity of the magnesium gas becomes extremely large, however, the reducing strength is not always increased in accordance with such increase of the quantity of the magnesium gas, and thus, magnesium is only wasted.

As a range of from a lower limit to a higher limit, it was optimum that the flow quantity of the argon gas was set to be one fourth to a half the flow quantity of the nitrogen gas.

Next, it is favorable that a solidification speed of the molten metal is set to be 600° C./minute or more (temperature decrease per unit time of the molten metal in the molding die 11) and preferably 800° C./minute or more. As the solidification speed is larger, a crystal structure of the cast product becomes denser; this feature is favorable since strength thereof is enhanced.

This solidification speed is in neighborhood of that of a conventional DC. However, this reduction casting method does not rely on rapid cooling as is done in a splash or spraying filling of the DC but is capable of performing filling of the molten metal in a stratified or a partially turbulent state to allow an inner quality to be extremely favorable, a DASII value to be also small and expansion, strength and the like to be enhanced.

Figure 2:
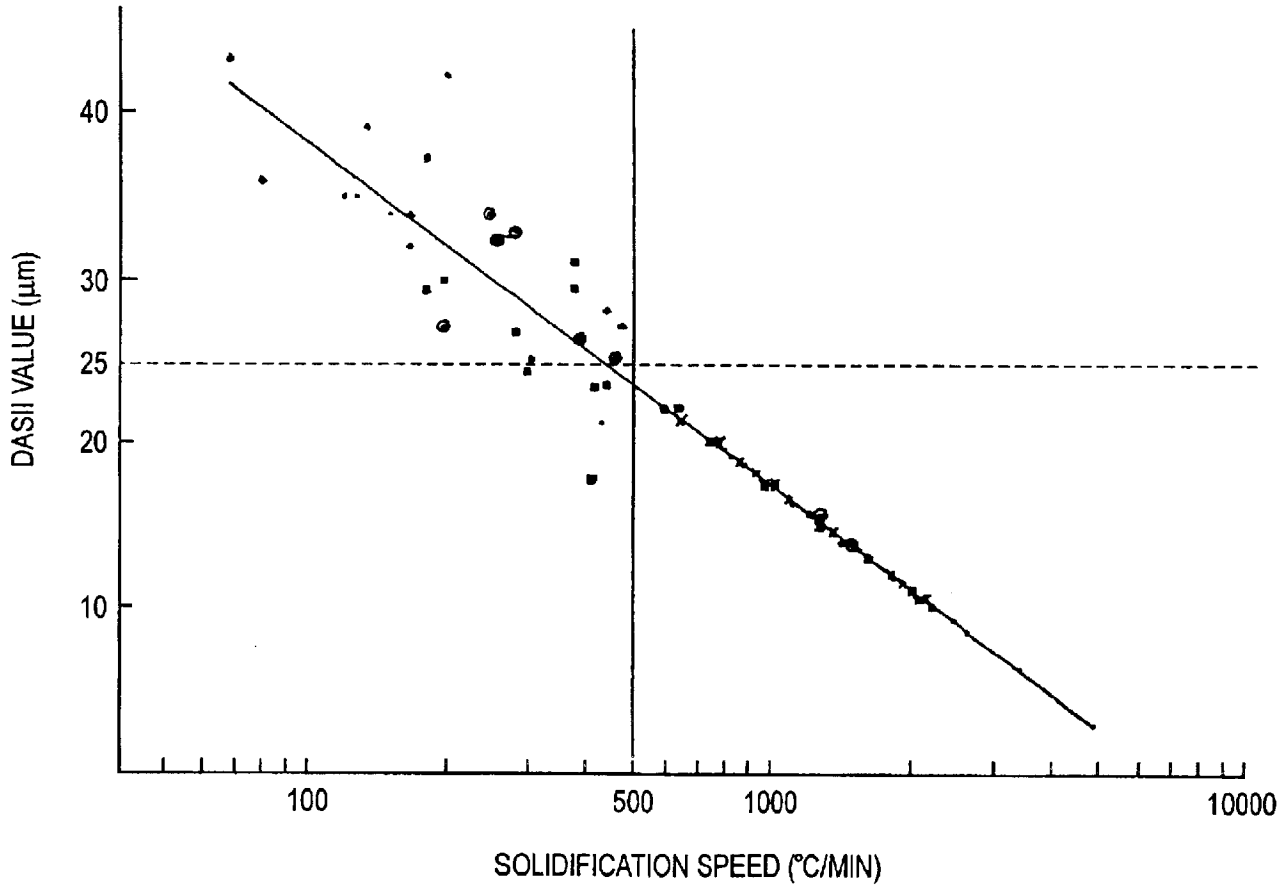
FIG. 2 is a graph showing, in regard to an aluminum material, a measurement result as to how DASII value varies in accordance with a solidification speed of a molten metal.

FIG. 2 shows a result of measurement as to how a space between dendrites in a solidified body is changed when the solidification speed of the molten metal is changed in aluminum casting.

The measurement was performed such that a portion of aluminum which has been filled into and solidified in the cavity 12 was taken out to be a sample and a space between dendrites thereof was measured by an electronic microscope. In FIG. 2, the solidification speed is shown in abscissa and the space between dendrites of solidified aluminum was shown in ordinate as "DASII value".

From FIG. 2, when the solidification speed is 600° C./min or more, the space between the dendrites of aluminum filled into and solidified in the cavity 12 becomes 22 μm or less in an average, while, when the solidification speed is 800° C./min or more, the space between the dendrites becomes 20 μm or less in an average.

The space between the dendrites of aluminum relates to density of the solidified body (cast product) and, as the space between the dendrites becomes smaller, the crystal structure of aluminum becomes denser, so that mechanical strength of the cast product obtained is enhanced.

From the standpoint of mechanical strength, the DASII value is 22 μm or less and preferably 20 μm or less.

In other words, in the above-described casting conditions, the term "the solidification speed of 600° C./minute or more (preferably 800° C./minute or more)" may be replaced by the term "the solidification speed at which the DASII value becomes 22 μm or less (preferably, the solidification speed at which the DASII value becomes 20 μm or less in the reduction casting method)".

In an conventional casting method, the solidification speed is slow and, particularly in GDC or LPDC in which a heat-insulating coating agent is used, particularly slow, and thus, it is difficult to correspond to demixing, shrinkage hole and the like; therefore, there is a problem as to how directional cooling is performed. In the above-described case, the solidification speed is about 100° C./min and, even in a thin wall part, is about 750° C./min and the DASII value to be described below was only in a level of from 35 μm to 20 μm.

Next, the filling time of the molten metal is studied.

The filling time of the molten metal is determined depending on a relation between a material of a cast alloy and the solidification speed.

Ordinarily, at the time of cooling the cast alloy such as AC2B and AC4B, there is a temperature difference of about 90° C. (decrease of 90° C.) between a temperature in the beginning of filling the molten metal and a temperature at completion of forming an α type dendrite crystal structure. Namely, by a temperature decrease of 90° C., solidification is can be performed. During this solidifying time period, it is necessary to complete filling of the molten metal into the cavity 12. When the solidification speed is set to be from 600° C./min to 2000° C./min, the filling time of the molten metal becomes from 9.0 seconds to 2.7 seconds.

On the other hand, at the time of cooling alloys for casting such as 2017, 2024 and 2618, there is a temperature difference of about 40° C. between a temperature in the beginning of filling the molten metal and a temperature at completion of forming the α type dendrite structure.

When the solidification speed is set to be from 600° C./min to 2000° C./min, the filling time of the molten metal becomes from 4.0 seconds to 1.2 second.

Namely, although there is a difference depending on materials to be used in the cast alloy, unless the filling of the molten metal into all parts of the cavity 12 is completed in a period of from about 1.0 second to about 9.0 seconds, a part of the molten metal in the cavity 12 starts to be solidified, thereby generating an insufficiently filled part.

Practically, among all parts of the cavity 12, there are some parts which are thick and other parts which are thin, namely, all parts are not necessarily uniform in thickness. The molten metal first runs into a thick part and, in late, into a thin part in which the solidification speed is fast and thus, there is a fear that solidification starts before the filling into the thin part is completed.

Therefore, it is necessary to perform controlling such that filling of the molten metal into all parts of the cavity 12 is completed.

In a case in which there is a thin part into which the molten metal is hard to run or other cases, it is favorable that the molten metal is applied with pressure by some device which is not limited to any particular type and all parts of the cavity 12 are filled with molten metal within a predetermined time in a same manner as in LPDC. For this reason, it is also important to appropriately select a diameter, a shape, a position, a number and the like of the sprue.

By performing controlling such that filling of the molten metal into all parts of the cavity 12 is completed, since the running property is favorable by nature, the molten metal is allowed to be assuredly filled even into a fine part of the cavity 12 whereby cast imperfections to be caused by, for example, insufficient filling can be eliminated. Further, since the oxide film formed on the surface of the molten metal is removed, a surface fold or the like is not generated on the surface of the cast product whereby the cast product having an excellent appearance can be obtained.

In the above-described embodiment, the magnesium gas, the nitrogen gas were directly introduced into the cavity to generate the magnesium-nitrogen compound; however, it is also permissible that a reaction chamber (not shown) is provided immediately in front of the molding die and, then, the argon gas, the magnesium gas and the nitrogen gas were introduced into the thus-provided reaction chamber to allow these gases to react thereamong in the reaction chamber and to generate the magnesium-nitrogen compound and, thereafter, the thus-generated magnesium-nitrogen compound is introduced into the cavity.

Further, the embodiment was explained with reference to the magnesium-nitrogen compound as the reducing substance of the molten metal, but a single body of magnesium or other reducing substances may also be used. As for the carrier gas, other inert gases or non-oxidizing gases than the argon gas may also be used. These gases are collectively called herein as "non-reactive gas".

According to the invention, the solidification speed and the filling time of the molten metal are not limited to those described above.

Still further, although the aluminum casting method was explained in the above-described embodiment but the method according to the invention is not limited thereto but is applicable to casting methods in which aluminum alloys, various types of metals such as magnesium and iron and alloys thereof are each used as a casting material.

According to the invention, as described above, by measuring the flow quantity of the measurable carrier gas and, then, controlling the flow quantity of the carrier gas to be a required quantity relative to the flow quantity of the reactive gas, the flow quantity of the metallic gas can indirectly be controlled whereupon a remarkable effect can be exhibited such that the reduction casting can be performed in an advantageous manner without impairing the reducing strength.

What is claimed is:

1. A reduction casting method, comprising the steps of:

allowing a metallic gas and a reactive gas to react with each other to generate a reducing compound;

filling the thus-generated reducing compound into a cavity of a molding die; and casting a cast product while reducing an oxide film formed on a surface of a molten metal by the reducing compound, wherein a non-reactive gas is used as a carrier gas of the metallic gas, wherein a flow quantity of the non-reactive gas is set to be from one sixth to twice a flow quantity of the reactive gas.

2. The reduction casting method as set forth in claim 1, wherein the flow quantity of the non-reactive gas is set to be from one fourth to one half the flow quantity of the reactive gas.

3. The reduction casting method as set forth in claim 1, wherein the reactive gas is a nitrogen gas, the non-reactive gas is an argon gas and the metallic gas is a magnesium gas.

4. The reduction casting method as set forth in claim 1, wherein the non-reactive gas is used as the carrier gas when the metallic gas is introduced into the cavity.

* * * * *